US009090267B2

(12) United States Patent
Shinmura et al.

(10) Patent No.: US 9,090,267 B2
(45) Date of Patent: Jul. 28, 2015

(54) RAILWAY VEHICLE BODY TILTING SYSTEM

(75) Inventors: Hiroshi Shinmura, Toyokawa (JP); Tetsuya Hayashi, Kasugai (JP); Nobuyuki Okada, Okazaki (JP); Naohide Kamikawa, Toyokawa (JP)

(73) Assignee: NIPPON SHARYO, LTD., Aichi (JP)

( * ) Notice: Subject to any disclaimer, the term of this patent is extended or adjusted under 35 U.S.C. 154(b) by 160 days.

(21) Appl. No.: 13/985,428

(22) PCT Filed: Apr. 28, 2011

(86) PCT No.: PCT/JP2011/060415

§ 371 (c)(1),
(2), (4) Date: Aug. 14, 2013

(87) PCT Pub. No.: WO2012/147195

PCT Pub. Date: Nov. 1, 2012

(65) Prior Publication Data

US 2013/0319284 A1 Dec. 5, 2013

(51) Int. Cl.

| | |
|---|---|
| ***B61F 5/22*** | (2006.01) |
| ***B61F 5/10*** | (2006.01) |
| ***B61F 5/02*** | (2006.01) |
| ***B61F 5/14*** | (2006.01) |
| ***B61C 17/00*** | (2006.01) |
| *B61F 99/00* | (2006.01) |

(52) U.S. Cl.

CPC . *B61F 5/22* (2013.01); *B61C 17/00* (2013.01); *B61F 5/02* (2013.01); *B61F 5/10* (2013.01); *B61F 5/144* (2013.01); *B61F 99/00* (2013.01)

(58) Field of Classification Search

CPC ..... B61F 5/02; B61F 5/10; B61F 5/22; B61F 5/144; B61C 17/00

USPC ..... 105/453, 199.2

See application file for complete search history.

(56) References Cited

U.S. PATENT DOCUMENTS 4,695,074 A 9/1987 Kobayashi et al.
8,667,900 B2 * 3/2014 Shinmura et al. ..... 105/199.1

FOREIGN PATENT DOCUMENTS

JP 61-095609 U 6/1986
JP 04176773 A * 6/1992 ..... B61F 5/10

(Continued)

OTHER PUBLICATIONS

Extended European Search Report dated Apr. 7, 2015, issued by the European Patent Office in counterpart European application No. 11864456.6.

*Primary Examiner* — Zachary Kuhfuss
(74) *Attorney, Agent, or Firm* — Sughrue Mion, PLLC

(57) ABSTRACT

A railway vehicle body tilting system has a height control valve for supplying and discharging compressed air to and from an air spring by an actuator, an auxiliary control valve for supplying compressed air to the air spring and thereby causing a car body to tilt, a backup valve for switching the connection between the air spring and either the height control valve or the auxiliary control valve, and a controller installed in each of vehicles linked together as a train. During normal operation, the controller provided in each of the cars controls the height control valve of the respective car and monitors for faulty operation in other linked controllers. If a fault arises in a linked controller, control over the malfunctioning controller is terminated, and another normal controller controls a backup valve in the car with the malfunctioning control device.

3 Claims, 4 Drawing Sheets

(56) References Cited

FOREIGN PATENT DOCUMENTS

| | | | |
|---|---|---|---|
| JP | H10-287241 | A | 10/1998 |
| JP | 2983516 | B2 | 11/1999 |
| JP | 2001-287642 | A | 10/2001 |
| JP | 2005-035321 | A | 2/2005 |
| JP | 2005-170334 | A | 6/2005 |
| JP | 3814237 | B2 | 8/2006 |
| JP | 2006-231968 | A | 9/2006 |
| JP | 2009-046027 | A | 3/2009 |
| JP | 2010-132123 | A | 6/2010 |
| JP | 2011-16441 | A | 1/2011 |

* cited by examiner

RAILWAY VEHICLE BODY TILTING SYSTEM

CROSS REFERENCE TO RELATED APPLICATIONS

This application is a National Stage of International Application No. PCT/JP2011/060415 filed Apr. 28, 2011, the contents of all of which are incorporated herein by reference in their entirety.

TECHNICAL FIELD

The present invention relates to a vehicle body tilting system for railway vehicle configured to adjust the height of air springs by air supply/discharge control to tilt a vehicle body. More particularly, the invention relates to a railway vehicle body tilting system in which even if an abnormality or failure occurs in one of controllers provided one each in vehicle bodies, a controller of another vehicle operates for backup of the failed controller to enable tilting of the vehicle body during traveling.

BACKGROUND ART

For allowing railway vehicles or cars to travel a curved section on a railway track, acceleration in right and left directions is decreased by so-called cant, and the railway vehicles are provided with a vehicle body tilting system to actively tilt vehicle bodies to make up for cant deficiency. One example of the vehicle body tilting systems includes a height control valve to supply/discharge compressed air to/from air springs supporting right and left sides of a vehicle body, the height control valve being controlled by a controller. In this vehicle body tilting system, the controller controls the height control valve based on spot information and speed information during traveling and previously prepared track data to control discharge/supply of compressed air with respect to the right and left air springs. With this configuration, the vehicle bodies are tilted when entering a curve and are returned to a horizontal state when going out of the curve.

RELATED ART DOCUMENTS

Patent Documents

Patent Document 1: JP-A-2005-35321

SUMMARY OF INVENTION

Problems to be Solved by the Invention

The aforementioned railway vehicle body tilting system is provided with controllers one by one in each vehicle body of a train composed of a plurality of vehicles. When even one controller of the vehicles is failed, the vehicle body of the vehicle with the failed controller could not be controlled to tilt. Thus, the entire train has to be driven to travel based on the malfunctioning vehicle. In other words, the traveling speed during traveling in a curve has to be greatly decreased in order to prevent deterioration ride comfort. This may cause a delay in arrival of the train, resulting in a problem with train service. In case any failure occurs during traveling in a curve, the train has to run without tilting until it is decelerated, which degrades ride comfort.

The present invention has been made to solve the above problems and has a purpose to provide a vehicle body tilting system for railway vehicle arranged to enable traveling of a vehicle body in a tilted state even if a controller for tilting is failed.

Means of Solving the Problems

To achieve the above purpose, one aspect of the invention provides a railway vehicle body tilting system comprising: a height control valve to be operated by an actuator to supply and discharge compressed air with respect to air springs; an auxiliary control valve to supply the compressed air to the air springs to tilt a vehicle body; a backup valve to change over connection between one of the height control valve and the auxiliary control valve and the air springs; and controllers one each installed in each of a plurality of vehicles coupled to one another to make up a train, wherein the controller provided in each of the vehicles controls the height control valve of the associated vehicle during normal condition and monitors abnormality in other linked controllers, and in case of abnormality occurring in one of the linked controllers, another normal controller stops control of the failed controller and controls the backup valve of the vehicle with the failed controller.

In the above railway vehicle body tilting system, preferably, the plurality of controllers provided in the train are configured to monitor abnormality of the opposite controllers provided in the vehicles arranged front and rear.

In the above railway vehicle body tilting system, preferably, a suction tank on a low pressure side and a discharge tank on a high pressure side are connected to each other via a motor pump, the air springs arranged left and right are connected to the suction tank and the discharge tank via a tilting control valve, the motor pump is driven to generate a pressure difference between the suction tank and the discharge tank, the tilting control valve is changed over to feed compressed air from the discharge tank to one of the right and left air springs and to suck compressed air from the other air spring to the suction tank, and each of the controllers is configured to control the associated tilting control valve during normal condition and, in case abnormality occurs in one of the controllers, to stop control of the tilting control valve.

Effects of the Invention

According to the invention, for example, controllers of vehicles arranged adjacently front and rear mutually monitor abnormality and, in case one of the controllers is failed, the other controller controls tilting of the adjacent vehicle. Even if an abnormality or failure occurs in any of the controllers, the vehicle bodies are allowed to travel in a tilting state and run in a curved section without greatly decreasing the traveling speed. Since the auxiliary control valves and the backup valves are provided, the failed controller and the normal controller that backs up the former control different targets. Thus, they can be configured without complicating respective circuits.

REFERENCE SIGNS LIST

Figure 1:
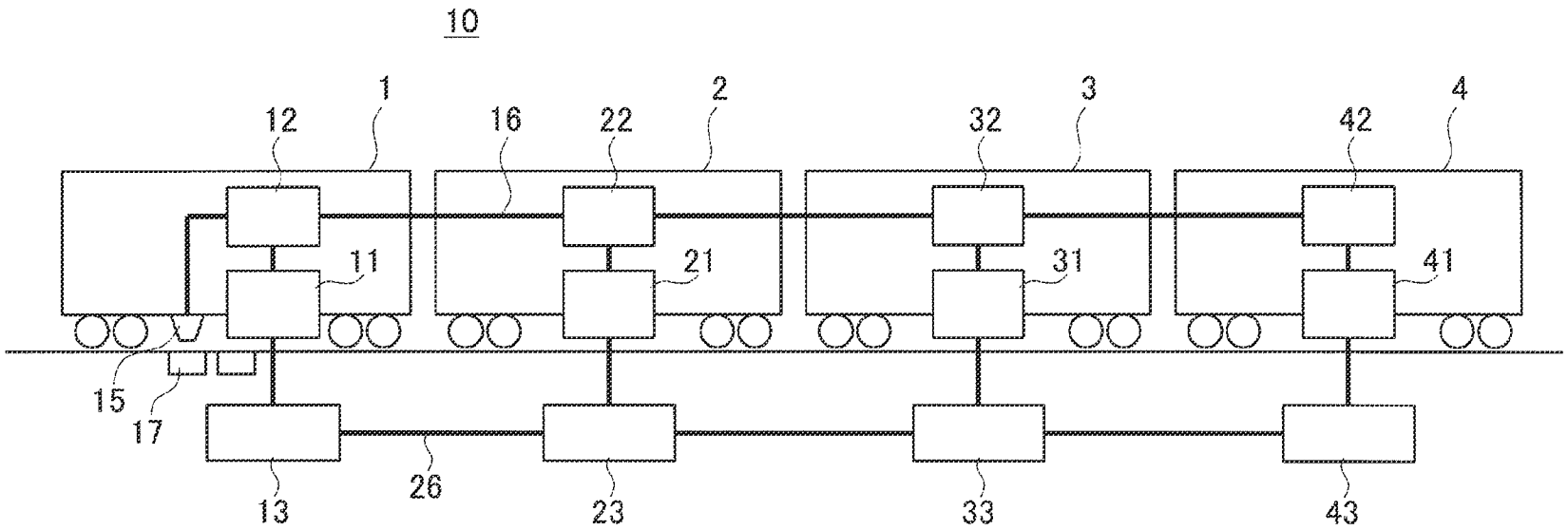
FIG. 1 is a conceptual diagram showing a train composed of a plurality of vehicles coupled to one another.

1, 2, 3, 4 Railway vehicle
11, 21, 31, 41 Controller
53 Air spring
70 Vehicle body tilting mechanism
71 Height control valve
72 Auxiliary control valve
73 Backup valve

MODE FOR CARRYING OUT THE INVENTION

A detailed description of a preferred embodiment of a vehicle body tilting system for railway vehicle embodying the present invention will now be given referring to the accompanying drawings. FIG. 1 is a conceptual diagram showing a train composed of a plurality of vehicles coupled to one another. This train 10 is a four-car-train made up of four railway cars or vehicles (hereinafter, simply referred to as "vehicles") referred to as first vehicle 1, second vehicle 2, third vehicle 3, and fourth vehicle 4 from the front. Each of the vehicles 1-4 is provided with a vehicle body tilting mechanism mentioned later. Further, controllers 11, 21, 31, and 41 are installed in the vehicles 1-4 respectively.

The controllers 11, 21, 31, and 41 are connected with one another through a monitor dedicated line 16 via monitors 12, 22, 32, and 42. The first vehicle is provided with a spot information detecting sensor 15. This sensor 15 receives spot information from ground coils 17 arranged at constant intervals along a track. The spot information detected by the spot information detecting sensor 15 and the speed information detected by a speed sensor mentioned later are transmitted to the controllers 11, 21, 31, and 41 via the monitors 12, 22, 32, and 42 respectively. In the present embodiment, furthermore, the controllers 11, 21, 31, and 41 are connected with one another through a control communication line 26 via repeaters 13, 23, 33, and 43 in preparation for communication failures of the monitors 12, 22, 32, and 42.

Figure 2:
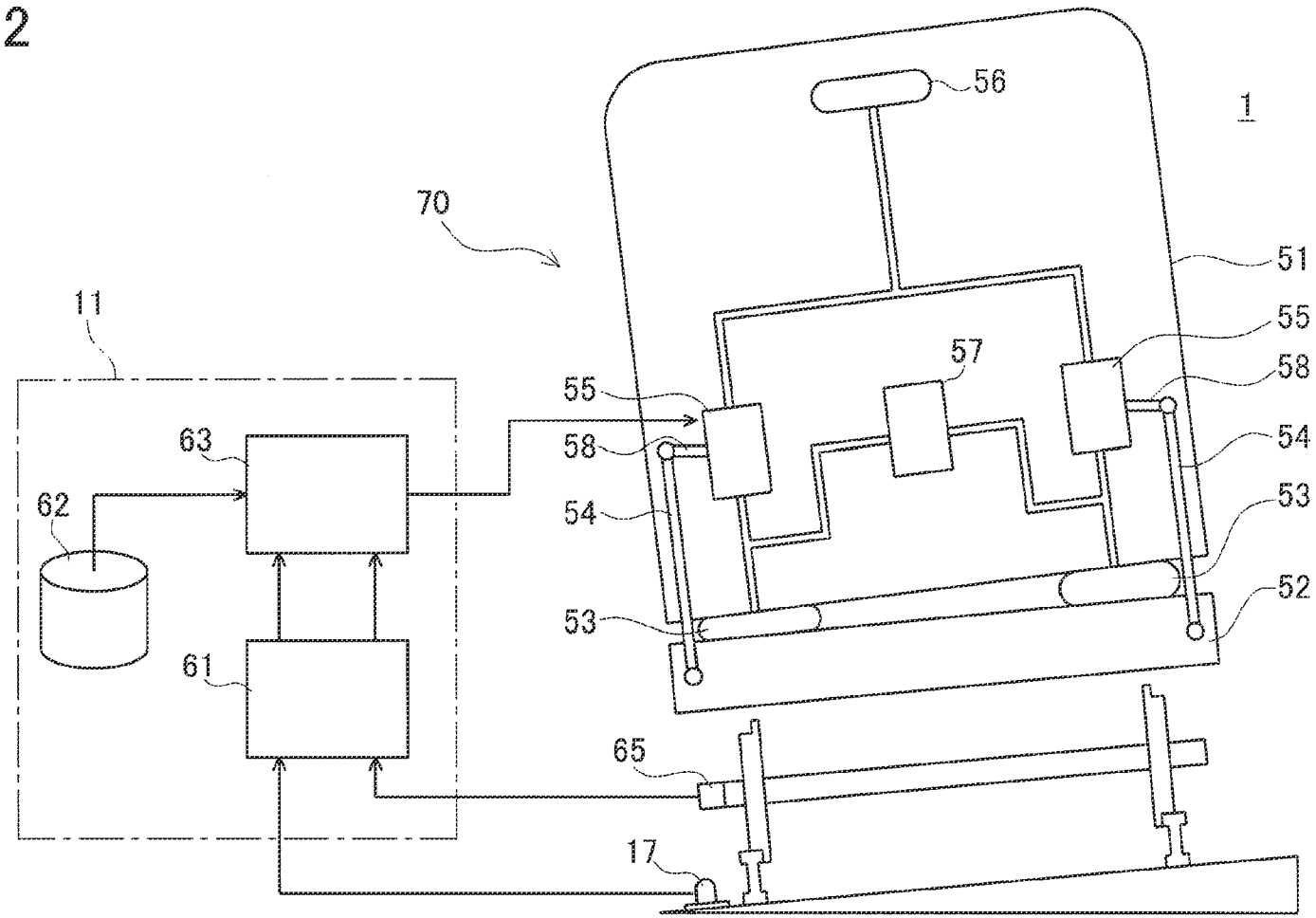
FIG. 2 is a schematic diagram showing a vehicle body tilting mechanism.

FIG. 2 is a schematic diagram showing a vehicle body tilting mechanism. Since the vehicles 1, 2, 3, and 4 are identically provided with vehicle body tilting mechanisms 70, only the vehicle body tilting mechanism 70 of the vehicle 1 will be explained below. A vehicle body 51 of the vehicle 1 is mounted on front and rear bogies 52 through air springs 53. The vehicle body tilting mechanism 70 includes height adjusting rods 54, height control valves 55, and others and is configured to tilt a vehicle body to compensate cant deficiency and also to maintain a constant vehicle height against load variations. Specifically, the vehicle body tilting mechanism 70 is arranged to supply and discharge compressed air with respect to the air springs 53 to adjust the height of the right and left air springs 53.

The right and left air springs 53 are respectively provided with the height control valves 55 and are connected to a main tank 56 through the height control valves 55. The main tank 56 is an air reservoir of the train 10. The right and left air springs 53 are connected to each other via a pump-operated tilting mechanism 57. In the present embodiment, expansion and contraction of each of the air springs 53 is controlled to tilt the vehicle body 51 to either the left or right. The pump-operated tilting mechanism 57 is configured to feed compressed air from one air spring to be contracted to the other air spring to be expanded.

Meanwhile, each of the height control valves 55 is a changeover valve to switch three ports between communication and shutoff with respect to the associated air spring 53, the main tank 56, and atmosphere. A valve stem not shown for operating changeover of each port is connected to a lever 58 which is further connected to the height adjusting rod 54, thereby making up a link mechanism. Each height control valve 55 provided in the vehicle body 51 is coupled to each bogie 52 by such a link mechanism so that expansion and contraction of the associated air spring 53 changes a distance between the vehicle body 51 and each bogie 52, thereby changing over the height control valve 55. Specifically, the height adjusting rod 54 is displaced in up and down directions, causing changeover of the valve to supply compressed air from the main tank 56 to the air spring 53 or discharge compressed air from the air spring 53 to the atmosphere. Each port is shut off when the link mechanism is returned to a predetermined position, thus stopping supply and discharge of compressed air.

The controller 11 is configured to control tilting of the vehicle body 51 and includes an information detecting section 61, a track data storing section 62, and a tilt command computing section 63. The information detecting section 61 receives a speed information signal from the speed sensor 65 provided on a wheel shaft and a spot information signal from the ground coils 17. The spot information signal is detected by the spot information detecting sensor 15 of the vehicle 1 shown in FIG. 1. Furthermore, those speed information signal and spot information signal are then transmitted to the controllers 21, 31, and 41 of subsequent vehicles through the monitor 12. On the other hand, the track data storing section 62 stores track data such as curved sections of a track on which the train 10 will travel, and their curvatures and cants. The tilt command computing section 63 calculates a tilt command value based on the speed information, spot information, and track information to control the height control valves 55 and others. The controllers 21, 31, and 41 have identical configurations excepting the information detecting section 61.

Figure 3:
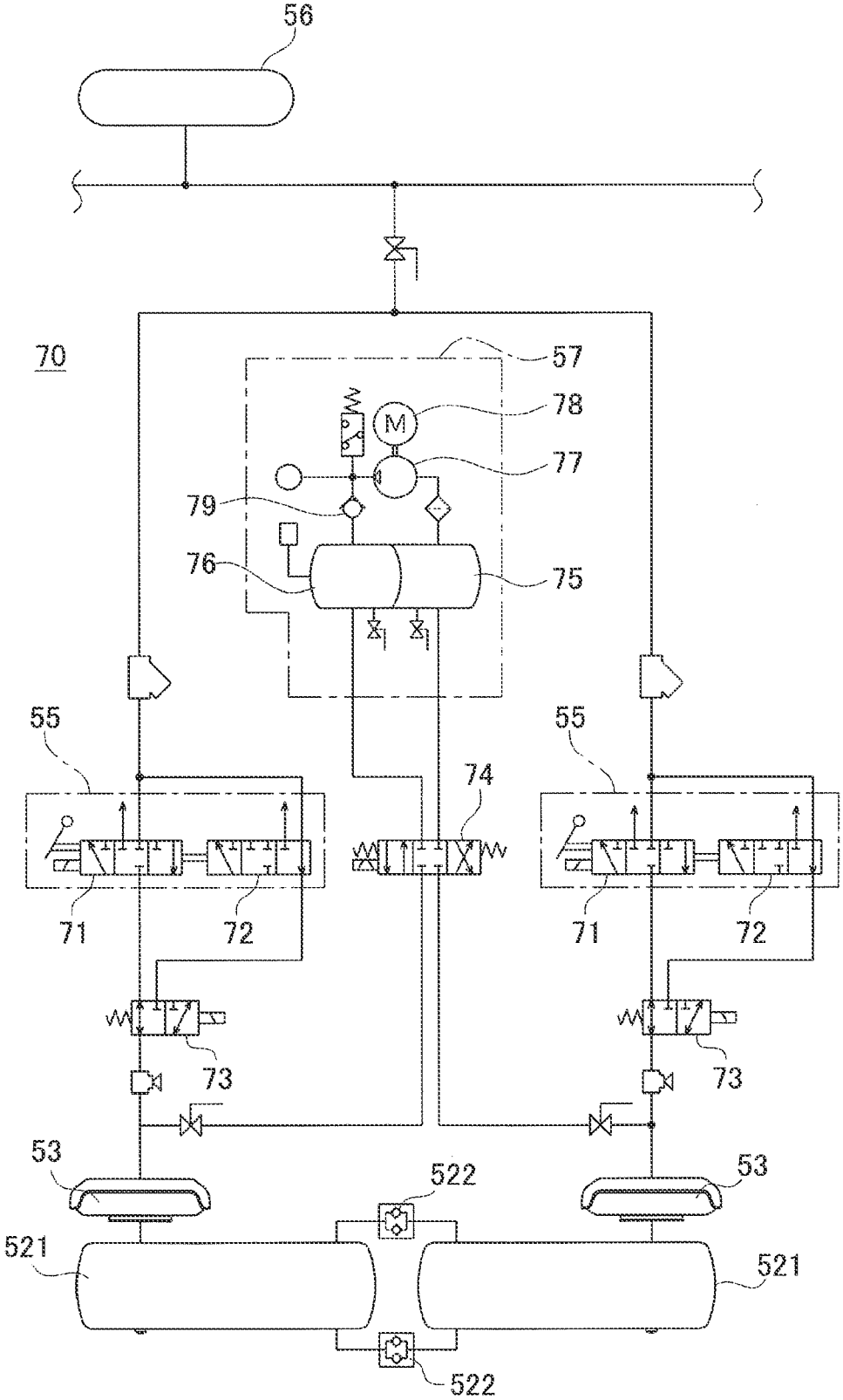
FIG. 3 is a circuit diagram showing a vehicle body tilting mechanism provided in a vehicle.

FIG. 3 is a circuit diagram showing the vehicle body tilting mechanism 70 provided in each of the vehicles 1-4. Each of the height control valves 55 shown in FIG. 2 is actually constructed of two 3-port changeover valves, i.e., a height control valve 71 and an auxiliary control valve 72 as shown in FIG. 3. The height control valve 71 and the auxiliary control valve 72 are provided in the vehicle body 51 as mentioned above and connected to the bogies 52 by the link mechanism. Accordingly, when the distance between the vehicle body 51 and each bogie 52 is changed by expansion and contraction of the air springs 53, the height control valves 55 are switched over. Furthermore, each height control valve 71 includes an actuator controllable by the controller 11 to thereby change over the ports. Specifically, controlling the height control valves 71 allows the vehicle body 51 to tilt in a curved section.

In case the controller 11 is failed, the height control valves 71 are disabled to tilt the vehicle body during traveling in a curve. In the present embodiment, therefore, the auxiliary control valves 72 are provided in case of failure of the controller 11. Each of the auxiliary control valves 72 is coupled to a link mechanism to supply compressed air to the associated air spring 53 while the vehicle body 51 is in a horizontal state. In the case where only the air spring 53 located on one side is expanded by the auxiliary control valve 72, the vehicle body 51 is tilted to the opposite side by 2°, for example. The height control valve 71 and the auxiliary control valve 72 are changed over by a backup valve 73 between during normal condition and during failed condition in which the controller 11 is failed or faulty. The height control valve 71 is thus used during normal condition, while the auxiliary control valve 72 is used during failed condition in which the controller 11 is failed.

The right and left air springs 53 are connected respectively to auxiliary air chambers 521 provided in a frame of each bogie 52. Those auxiliary air chambers 521 are coupled to each other via differential pressure valves 522. Further, the pump-operated tilting mechanism 57 is configured to transfer compressed air back and forth between the right and left air springs 53 to control the tilting of the vehicle body. The pump-operated tilting mechanism 57 includes a suction tank 75 to suck compressed air from the air springs 53 and a discharge tank 76 to feed compressed air to the air springs 53.

The suction tank 75 and the discharge tank 76 are connected to the right and left air springs 53 via a control valve for tilting operation (a "tilting control valve") 74. This tilting control valve 74 during normal condition is configured so that the suction tank 75 and the discharge tank 76 are shut off from the right and left air springs 53. A pump for tilting operation (a "tilting pump") 77 to be driven by a motor 78 is connected between the discharge tank 76 and the suction tank 75 to generate a pressure difference between those tanks.

A check valve 79 is provided between the tilting pump 77 and the discharge tank 76 to prevent backflow of compressed air to maintain the inner pressure of the discharge tank 76. In addition, a filter is provided between the tilting pump 77 and the suction tank 75. The discharge tank 76 which is subjected to high pressure is provided with a safety valve. On a downstream side of the tilting pump 77, a pressure sensor and a pressure switch for abnormality detection are provided. Even though the above pump-operated tilting mechanism 57 needs the installation space of the suction tank 75 and the discharge tank 76, this tilting mechanism 57 has a compact size as small as 15 liters, whereas the main tank 56 has a capacity of 100 liters.

Figure 4:
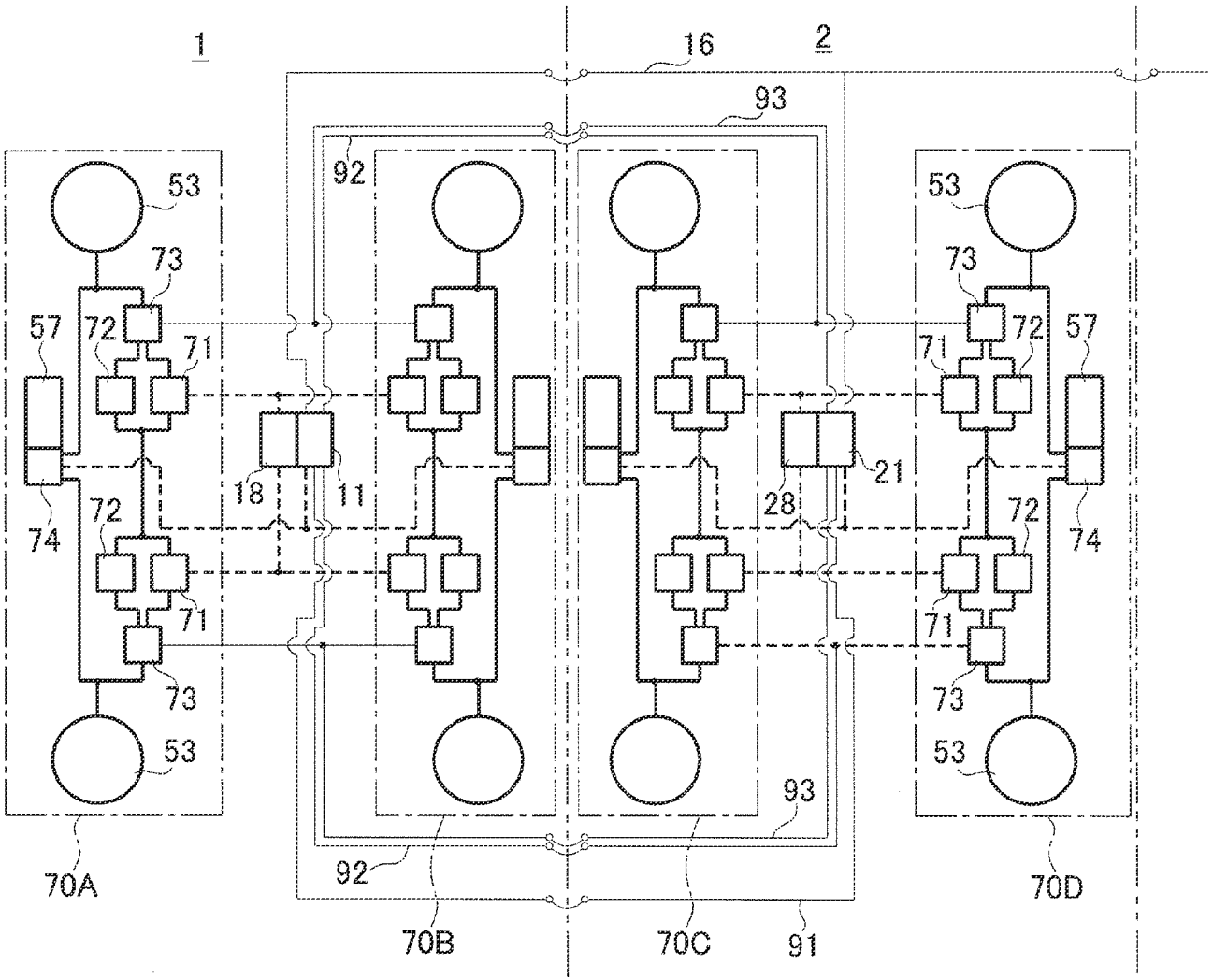
FIG. 4 is a circuit diagram showing an embodiment of a vehicle body tilting system.

FIG. 4 is a circuit diagram showing a vehicle body tilting system in the present embodiment. This figure shows the configuration of the adjacent vehicles 1 and 2. In each of the vehicles 1 and 2, two sets of vehicle body tilting mechanisms 70 are provided, which will be explained with reference signs 70A, 70B, 70C, and 70D. The reference signs of the air springs 53 and other components are identical among the tilting mechanisms and thus those reference signs are given to only the vehicle body tilting mechanisms 70A and 70D and omitted in the vehicle body tilting mechanisms 70B and 70C.

In the vehicle 1, the controller 11 is provided for the vehicle body tilting mechanisms 70A and 70B. In the vehicle 2, the controller 21 is provided for the vehicle body tilting mechanisms 70C and 70D. Each of the controllers 11 and 21 is connected to the height control valves 71 and the tilting control valves 74 which are targets for control. A drive amplifier 18 is provided between the controller 11 and the associated height control valves 71. A drive amplifier 28 is provided between the controller 21 and the associated height control valves 71.

The controller 11 of the vehicle 1 obtains traveling position information and traveling speed information respectively from the spot information detecting sensor 15 and the speed sensor 65 shown in FIGS. 1 and 2, but not shown in FIG. 4. To transmit such information to subsequent vehicles 2, 3, and 4, the controller 11 is linked to the controller 21 via the monitor dedicated line 16, and further to the controllers 31 and 41. In addition, an abnormality detection line 91 and others are connected between the vehicles. This corresponds to the control communication line 26 shown in FIG. 1. The abnormality detection line 91 and others are provided so that, in case the controller of one of the vehicles is failed, the controller of another vehicle is instead used for control of the failed vehicle. In the present embodiment, the two vehicles 1 and 2 (the same applies to the vehicles 3 and 4) arranged adjacent in front and rear are configured to mutually monitor abnormality of the opposite controllers 11 and 21 and back up each other.

The controllers 11 and 21 are linked to each other by the abnormality detection line 91 to detect abnormality. The controller 11 of the vehicle 1 is connected to the backup valves 73 of the vehicle body tilting mechanisms 70C and 70D of the vehicle 2 through control command lines 92. The controller 21 of the vehicle 2 is connected to the backup valves 73 of the vehicle body tilting mechanisms 70A and 70B of the vehicle 1 through the control command lines 93. Accordingly, in the event of trouble or failure in one of the controllers 11 and 21, the other controller 21 or 11 receives an abnormality signal through the abnormality detecting line 91 and controls the vehicle body tilting mechanism 70 of the failed controller 11 or 21 through the control command lines 92 or 93.

During normal condition, the controller 11 controls the height control valves 71 and the tilting control valve 74 of each of the vehicle body tilting mechanisms 70A and 70B and the controller 21 controls the height control valves 71 and the tilting control valve 74 of each of the vehicle body tilting mechanisms 70C and 70D to respectively tilt the vehicle bodies 51 of the vehicles 1 and 2. Therefore, for example, when the controller 21 is failed and rendered inoperable, the function of the controller 21 is stopped, and instead, the controller 11 starts to control the vehicle body tilting mechanisms 70C and 70D to tilt the vehicle body 51 of the vehicle 2. At that time, the controller 11 controls the backup valves 73 of the vehicle 2, instead of controlling the height control valves 71 and the tilting control valves 74 which have been controlled by the controller 21. If the controller 11 is failed, the controller 21 similarly executes the backup control.

As above, for example, focusing on the vehicle body tilting mechanisms 70C and 70D, target components to be controlled by the controller 21 during normal condition are different from those to be controlled by the controller 11 during failed condition. On the other hand, it is also conceivable that a backup circuit is configured as a dual-redundant circuit so that the controllers 11 and 21 mutually control the opposite height control valves 71 and tilting control valves 74. However, the dual-redundant circuit has such problems that it shorts out in the case where voltage is different between both controllers and a circuit has a complicated structure to prevent back current. Furthermore, since the drive amplifiers 18 and 28 and others are provided between the controllers 11 and 21 and the height control valves 71, if control signals are allowed to be transferred in both directions between the controllers, the circuit is also made complicated in this regard. In the present embodiment, therefore, the auxiliary control valves 72 and the backup valves 73 are provided so that the controllers 11 and 21 do not control the backup valves 73 in the same vehicle in which the controller 11 or 21 itself is installed and do control the backup valves 73 in the opposite vehicle.

The operations of the vehicle body tilting system will be explained below. When passengers board or exit a train, firstly, the vehicle body 51 moves down or up in association with load variations thereon and the distance from the bogie 52 is changed. Thus, the height adjusting rods 54 are relatively displaced in up and down directions with respect to the vehicle body 51, thereby switching over the height control valves 55 (the height control valves 71 shown in FIG. 3). When the number of passengers decreases and thus the vehicle body 51 rises, the compressed air is discharged from the air springs 53. To the contrary, when the number of passengers increases and thus the vehicle body 51 is lowered, the compressed air is supplied to the air springs 53. In this way, the vehicle body height is kept constant. As the vehicle body 51 returns to a predetermined height, the height adjusting rods 54 also return to their predetermined positions, thereby stopping air supply/discharge by the height control valves 71. While the controller 11 and others are in a normal state, the backup valves 73 allow the height control valves 71 to be connected to the air springs 53 as shown in FIG. 3.

Subsequently, the running train 10 obtains the traveling position information and the traveling speed information respectively from the spot information detecting sensor 15 and the speed sensor 65 provided in the lead vehicle 1. Those spot information and speed information are transmitted to the controllers 11, 21, 31, and 41 via the monitors 12, 22, 32, and 42. Each of the controllers 11, 21, 31, and 41 executes the vehicle body tilting control based on the spot information and speed information, and curved-section information such as a curvature, cant amount, and others of the curved section retrieved from the track information of the own track data storing section 62. In the vehicle body tilting control, tilting of the vehicle body 51 is performed by the pump-operated tilting mechanisms 57 and fine adjustment of the height control valves 71 is performed by use of an actuator.

In each pump-operated tilting mechanism 57, the pump 77 is operated to feed compressed air from the suction tank 75 to the discharge tank 76 in advance of performing tilting control, so that the discharge tank 76 is pressurized up to about 0.9 MPa as equal as the pressure in the main tank 56 and the suction tank 75 is depressurized to about atmospheric pressure. When the vehicle body 51 is to be tilted to the left as shown in FIG. 2, for instance, the tilting control valve 74 is changed over to connect the left air spring 53 to the suction tank 75 and connect the right air spring 53 to the discharge tank 76.

Each of the air springs 53 has an inner pressure of about 0.3 to 0.5 MPa. Thus, the compressed air in the left air spring 53 is sucked into the suction tank 75 having atmospheric pressure while the compressed air is caused to flow in the right air spring 53 from the discharge tank 76 having high pressure. Accordingly, the left air spring 53 is lowered as the compressed air is discharged therefrom, while the right air spring 53 is raised as the compressed air is supplied thereto, thereby tilting the vehicle body 51 to the left. The tilting control valve 74 is changed over just before the vehicle body 51 reaches a target tilting angle to shut off a flow of compressed air between the suction tank 75 and the discharge tank 76 and the right and left air springs 53. The tilting control of the vehicle body 51 is then taken over by the height control valves 71.

The right and left height control valves 71 are changed over by actuators to adjust a tilting state of the vehicle body 51. Specifically, the left height control valve 71 allows the compressed air to be discharged from the air spring 53 to atmosphere and the right height control valve 71 allows the compressed air to be supplied from the main tank 56 to the air spring 53. The tilting state of the vehicle body 51 is finely adjusted by supply/discharge of compressed air with respect to the air springs 53 until the vehicle body 51 comes to a predetermined tilting position. Then, the height control valves 71 are changed over to shut off the flow of compressed air.

Thereafter, when the railway vehicle exits the curved section of the traveling track, the vehicle body 51 is returned to the horizontal state. In this case, the tilting control valves 74 are changed over to connect the left air springs 53 to the discharge tank 76 and connect the right air springs 53 to the suction tank 75. Accordingly, contrary to the tilting operation mentioned above, the compressed air is fed from the discharge tank 76 to the left air springs 53 while the compressed air in the right air springs 53 is discharged to the suction tank 75. Furthermore, also in this case, the tilting control of the vehicle body 51 is taken over by the height control valves 71 for fine adjustment. The above tilting and returning operations are also similarly performed for tilting to the right.

The above tilting control of the vehicle bodies 51 are performed by the controllers 11, 21, 31, and 41 installed respectively in the vehicles 1, 2, 3, and 4. In the event of failure in the controller 21, for example, the vehicle body tilting of the vehicle 2 is controlled by the controller 11 of the vehicle 1 under mutual monitoring. During traveling, the controller 11 checks if the controller 21 is turned off or a flag is set due to some failures. The controller 11 stops subsequent control of the controller 21 and takes over the vehicle body tilting control of the vehicle 2. The controller 11 controls the tilting control valves 74 and the height control valves 71 of the own vehicle 1 and also controls the vehicle 2 as below.

To tilt the vehicle body 51 to the left, for example, the right backup valves 73 are controlled by the controller 11. By changeover of the backup valves 73, the right air springs 53 are connected to the auxiliary control valves 72. These auxiliary control valves 72 are configured to tilt the vehicle body 51 by 2° from the horizontal state. To be concrete, the compressed air is supplied from the main tank 56 to the right air springs 53 via the auxiliary control valves 72, thereby expanding the right air springs 53. The vehicle body 51 is thus raised on the right side and tilted to the left. When the vehicle body 51 is tilted by e.g. 2°, that is, when the right side of the vehicle body 51 is lifted upward to tilt at 2°, the ports of each auxiliary control valve 72 are changed over to disconnect from the air springs 53.

On the other hand, when the vehicle body 51 is to be returned to the horizontal state, each backup valve 73 is changed over into the state shown in FIG. 3 by the controller 11. Thus, the expanded right air springs 53 are connected to the height control valves 71. In the case where no actuator is operated, the height control valves 71 allow the air springs 53 to be connected to atmosphere to return the vehicle body 51 into the horizontal state. Therefore, the compressed air in the right air springs 53 is released to atmosphere. When the vehicle body 51 returns to the horizontal state, the height control valves 71 are changed over to shut off connection to atmosphere. The above tilting and returning operations are also similarly performed for tilting to the right. In the case of tilting to the right, the compressed air is supplied to the left air springs 53.

Even if the controller 21 is failed as above, the controller 11 instead executes the control for tilting the vehicle body 51 of the vehicle 2. At that time, the tilting operation of the vehicle 2 does not use the pump-operated tilting mechanisms 57 and thus the tilting speed thereof is slower than the tilting control in the normal condition. Accordingly, the controller 11 performs computing processing by taking into consideration the vehicle body tilting speed as well as the traveling position of the vehicle 2 and transmits a control command to the backup valves 73 of the vehicle 2. Based on this signal, the vehicle 2 starts to tilt short of a tilting start position of the vehicle 1 on the track and starts to return to the horizontal state.

In the vehicle body tilting system of the present embodiment, the vehicles 1 and 2 adjacently arranged front and rear mutually monitor abnormality in the opposite controllers 11 and 21 (in the case of the vehicles 3 and 4, they mutually monitor the opposite controllers 31 and 41). If abnormality occurs in either the controller 11 or the controller 21 due to some failures, the other controller performs tilting control of the opposite vehicle body 51. Even if the controller is failed, accordingly, the associated vehicle is allowed to travel in a curved section without greatly decreasing the traveling speed. Since the auxiliary control valves 72 and the backup valves 73 are provided and, for example, the controller 21 and the controller 11 that backs up the controller 21 are configured to control different targets, the circuit can be made up without becoming complex.

In the present embodiment, each of the pump-operated tilting mechanisms 57 makes transfer of compressed air between the right and left air springs 53. This eliminates discharge of a large amount of compressed air when the air springs 53 are to be contracted. Thus, consumption of compressed air can be reduced. Even when tilting control of the vehicle body 51 is repeated in a section including successive curves, the consumption of compressed air can be largely reduced. This can avoid size increase of a compressor not shown and the main tank 56 and the necessity of a plurality of compressors and main tanks. Therefore, initial costs and maintenance costs can be reduced and further generation of compressed air by the compressor can be reduced, leading to improved energy efficiency.

The present invention is not limited to the above embodiment and may be embodied in other specific forms without departing from the essential characteristics thereof. For instance, it may be arranged so that controllers of three vehicles mutually monitor. The mutually monitoring controllers do not always need to be installed in adjacent vehicles if only the controllers monitor one controller in another vehicle. Although the above embodiment exemplifies the system including the pump-operated tilting mechanisms 57, even a system having no pump-operated tilting mechanism 57 is also able to supply/discharge compressed air with respect to the right and left air springs 53 by use of only the height control valves 71 to tilt the vehicle body 51. Therefore, the pump-operated tilting mechanisms 57 are not essential elements.

The invention claimed is:

1. A railway vehicle body tilting system comprising: a height control valve to be operated by an actuator to supply and discharge compressed air with respect to air springs; an auxiliary control valve to supply the compressed air to the air springs to tilt a vehicle body; a backup valve to change over connection between one of the height control valve and the auxiliary control valve and the air springs; and controllers one each installed in each of a plurality of vehicles coupled to one another to make up a train, wherein the controller provided in each of the vehicles controls the height control valve of the associated vehicle during normal condition and monitors abnormality in other linked controllers, and in case of abnormality occurring in one of the linked controllers, another normal controller stops control by a failed controller and controls the backup valve of the vehicle with the failed controller.

2. The railway vehicle body tilting system according to claim 1, wherein the plurality of controllers provided in the train are configured to monitor abnormality of opposite controllers provided in vehicles arranged in front and rear directions.

3. The railway vehicle body tilting system according to claim 1, wherein a suction tank on a low pressure side and a discharge tank on a high pressure side are connected to each other via a motor pump, the air springs arranged left and right are connected to the suction tank and the discharge tank via a tilting control valve, the motor pump is driven to generate a pressure difference between the suction tank and the discharge tank, the tilting control valve is changed over to feed compressed air from the discharge tank to one of the right and left air springs and to suck compressed air from the other air spring to the suction tank, and each of the controllers is configured to control the associated tilting control valve during normal condition and, in case abnormality occurs in one of the controllers, to stop control of the tilting control valve.

* * * * *